United States Patent [19]

Blight

[11] Patent Number: 4,591,164

[45] Date of Patent: May 27, 1986

[54] BOOMERANG

[75] Inventor: Marshall R. Blight, Nedlands, Australia

[73] Assignee: Emeraldine Limited, London, England

[21] Appl. No.: 696,870

[22] Filed: Jan. 30, 1985

Related U.S. Application Data

[63] Continuation of Ser. No. 454,063, Dec. 28, 1982, abandoned.

[30] Foreign Application Priority Data

Apr. 29, 1982 [AU] Australia ..... PF3793
Jul. 16, 1982 [AU] Australia ..... PF4902

[51] Int. Cl.[4] ..... A63B 65/08
[52] U.S. Cl. ..... 273/425; 273/426
[58] Field of Search ..... 273/424–426; 446/36–45, 34, 46–48

[56] References Cited

U.S. PATENT DOCUMENTS

| | | | |
|---|---|---|---|
| 692,608 | 2/1902 | Bristow | 273/426 |
| 1,222,996 | 4/1917 | Rhodes | 46/83 |
| 2,324,022 | 7/1943 | Prause, Jr. . | |
| 2,838,310 | 6/1958 | Redka | 273/426 |
| 3,082,572 | 3/1963 | Knox, Jr. . | |
| 3,220,142 | 11/1965 | Butterfield . | |
| 3,403,909 | 10/1968 | Cleveland et al. | 273/426 |
| 3,570,467 | 3/1971 | Belokin, Jr. . | |
| 3,955,817 | 5/1976 | Davis . | |
| 4,045,029 | 8/1977 | Katzmark | 273/425 |
| 4,104,822 | 8/1978 | Rodgers | 273/425 X |
| 4,222,573 | 9/1980 | Adler | 273/426 |
| 4,337,950 | 7/1982 | Gidge | 273/426 |
| 4,421,320 | 12/1983 | Robson | 273/426 X |
| 4,456,265 | 6/1984 | Adler | 273/425 |

FOREIGN PATENT DOCUMENTS

| | | | |
|---|---|---|---|
| 289489 | 8/1966 | Australia | 273/426 |

*Primary Examiner*—Paul E. Shapiro
*Attorney, Agent, or Firm*—Bernard, Rothwell & Brown

[57] ABSTRACT

The present invention provides a substantially flat boomerang device comprising a flat central ring member having inner and outer circular boundaries and defining a central aperture, at least two wing members projecting outwardly from the outer boundary of the ring substantially in the plane thereof, each wing member being of asymmetrical aerofoil section and being arranged to act in the same direction as all of the other wings, such that when the device is thrown with a rotary motion the wings produce lift and also turn. The wing members are backwardly swept by an angle in the range of 2° to 20° and flat, drag-reducing skirts are provided extending between the sides of the wings and adjacent sides of the outer ring.

4 Claims, 13 Drawing Figures

BOOMERANG

This is a continuation of application Ser. No. 454,063 filed Dec. 28, 1982 now abandoned.

The present invention relates to boomerangs.

Boomerangs are well known devices which typically comprise a pair of members disposed at an angle to one another. The members are typically so shaped that if the device is thrown it will describe a path by which it returns to the vicinity of the thrower.

The present invention provides a boomerang of different construction to known boomerangs.

In accordance with the present invention there is provided a substantially flat boomerang device comprising a flat central ring member having inner and outer circular boundaries and defining a central aperture, at least two wing members projecting outwardly from the outer boundary of the ring substantially in the plane thereof, each wing member being of asymmetrical aerofoil section and being arranged to act in the same direction as all of the other wings, such that when the device is thrown with a rotary motion the wings produce lift and also turn.

The present invention will now be described, by way of example, with reference to the accompanying drawings, in which.

Figure 1:
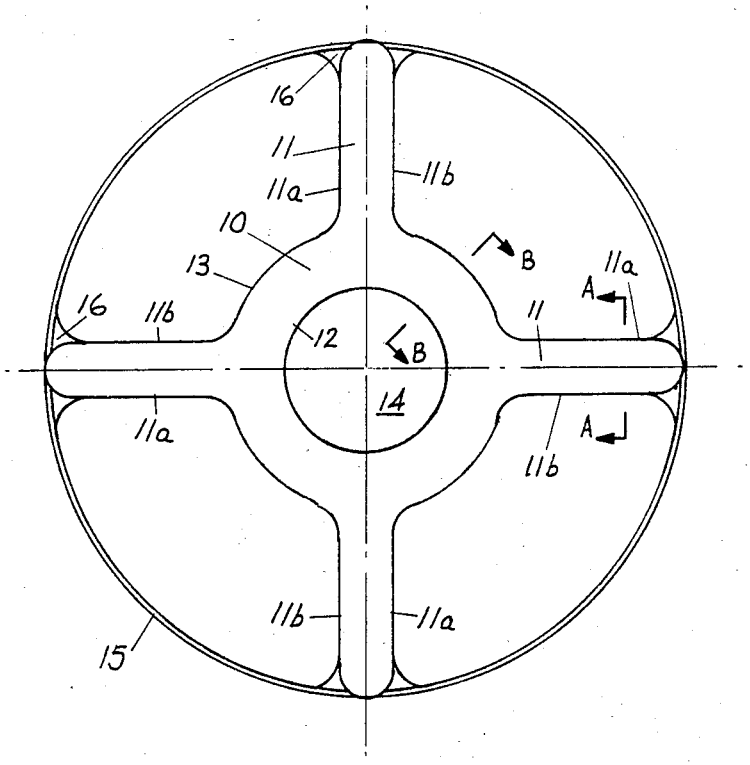
FIG. 1 is a plan view of one embodiment of a four winged boomerang in accordance with the present invention.
Figure 2:
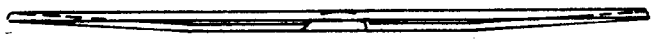
FIG. 2 is a side elevation of the boomerang of FIG. 1.

In FIGS. 1 and 2. there is shown a four winged boomerang device in accordance with the present invention which comprises a central ring 10 having four wings 11 projecting normally outwardly therefrom at 90° spacings. The ring 10 has an inner circular boundary 12 and an outer circular boundary 13. The ring 10 further defines a central aperture 14.

Figure 5B:
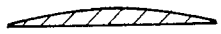
FIG. 5B is a transverse section along the lines B—B of FIGS. 1 and 3.

As shown in FIG. 5B the ring 10 has a symmetrical aerofoil section which is flat underneath and symmetrically arched on top.

The use of a ring 10 with a central aperture 14 has the advantage that, in flight, air can pass through the middle of the ring 10 which reduces drag. Also, the aerofoil section of the ring 10 has the advantage of imparting gliding lift to the boomerang device in flight.

The circular ring shape is found to conserve spin efficiently especially compared to more angular shapes such as triangles or squares, and this is found to be an important advantage in obtaining good flight characteristics.

Figure 5A:
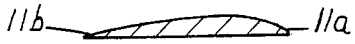
FIG. 5A is a transverse section along the lines A—A of FIGS. 1 and 3.

Further, as shown in FIG. 5A, each wing 11 has an asymmetrical aerofoil section whereby one side is flat and the other side is curved. The portion of the wing 11 adjacent the edge 11*a* which will be leading in rotational flight is thicker than the portion of the wing 11 adjacent the edge 11*b* that will be trailing. Each wing 11 is shaped so that its thicker edge 11*a* faces the same way as the thicker edges of all of the other wings 11.

As shown, the wings 11 are all of the same length and width and thickness and are mounted symmetrically about the ring 10. However, it is not absolutely essential for the boomerang device to be symmetrical. It is preferred that the centre of gravity of the device be at the centre of the ring 10. If the wings 12 were in some way asymmetrically disposed either in location or size, shape or weight then, if desired, the centre of gravity could be maintained at the preferred location by appropriately counterweighting the opposite side of the device.

It must be emphasised that it is preferred for the wings 11 be the same and to project outwardly from the ring 10 in a symmetrical manner such that each pair of adjacent wings are spaced apart by the same angle such as 90°, this means that in the preferred embodiment each wing 11 makes an equal contribution to the flight of the boomerang device. Further, the wings 11 are preferably spaced so that they are non-overlapping when viewed in plan.

Still further, in the construction shown the ring 10 is of substantially the same thickness as the wings 11 at their greatest thicknesses and the ring 10 is completely flat on one side and aerodynamically, symmetrically arched on the other. However, there is no reason why the wings 11 and ring 10 could not be of different thicknesses.

It is preferred to have a flat side on the reverse to the symmetrical aerofoil side of the ring 10. It is preferred that the ring 10 be of symmetrical aerofoil section since in use as the device rotates, a side of the ring 10 which is leading at one moment will be trailing at the next.

Further, as shown the boomerang device may comprise an outer circular ring 15. This outer ring 15 is partly included for safety purposes. Preferably, the outer ring 15 has a reduced thickness such as about ½ thickness compared to the rest of the device and is circular or elliptical in cross-section to reduce any adverse effect on flight characteristics of the boomerang.

Further, the junctions between the wings 11 and the outer ring 15 may comprise skirt portions 16 to reduce drag. The skirt portions 16 are flat portions with flat opposed surfaces and they are located in the corners between the wings 11 and the outer ring 15.

Still further, it is found that the wings 11 may be bent slightly out of the plane of the ring 10 away from the flat side thereof for increased flight stability. The angle of bend may typically be up to 5° such as about 2°.

In use, the boomerang device of FIGS. 1 and 2 is thrown in similar manner to a conventional boomerang. That is, the device may be launched at an angle of about 45° into the wind. The device is launched in relation to the ground at an angle between vertical and say 40° off vertical leaning outwardly from the thrower. Further, the device is thrown with a spinning action so that the whole device adopts a rotating motion. The interaction of the turning lift produced by the wings 11 in rotating flight and the gyroscopic progression of the whole device results in a curving flight which returns the device to the vicinity of the thrower.

Figure 3:
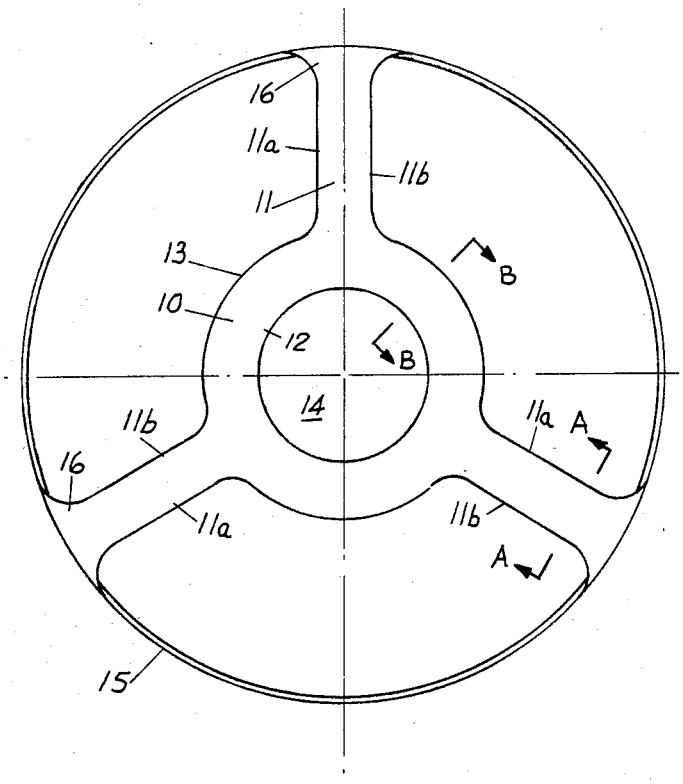
FIG. 3 is a plan view of one embodiment of a three winged boomerang device in accordance with the present invention.
Figure 4:
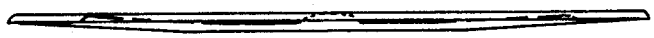
FIG. 4 is a side elevation of the boomerang of FIG. 3.

In FIGS. 3 and 4 there is shown a device similar to that shown in FIGS. 1 and 2 except that it comprises three symmetrically disposed wings projected outwardly at 120° spacings.

The number of wings can vary widely. However, if the number of wings increases it is thought that mutual interference between wings will also increase due to air turbulence and the overall amount of drag will increase. Preferably, the boomerang device of the present has from 2 to 6 wings such as 3 or 4.

For best results it is preferred that the overall proportions of the device be maintained within certain limits.

For example, the ratio x/d between x (ring 10 outer diameter) and d (overall diameter) is preferably between about 0.3 and about 0.6. For a four winged device it is preferably about 0.41 while for a three winged device it is preferably about 0.51.

Other preferred ratios are as follows:

$$\frac{1}{d}\ \frac{\text{(wing length)}}{\text{(overall diameter)}}:$$

about 0.2 to about 0.35 (preferably about 0.28 for four wings, about 0.24 for three wings)

$$\frac{w}{d}\ \frac{\text{(average)}\ \text{(wing width)}}{\text{(overall diameter)}}:$$

about 0.05 to about 0.1 (preferably about 0.08 for four and three wings)

$$\frac{y}{d}\ \frac{\text{(ring width)}}{\text{(overall diameter)}}:$$

about 0.05 to about 0.1 (preferably about 0.07 for four wings, about 0.076 for three wings)

$$\frac{z}{d}\ \frac{\text{(greatest wing thickness)}}{\text{(overall diameter)}}:$$

about 0.008 to about 0.015 (preferably about 0.01 for four wings and about 0.013 for three wings)

Also, when the outer safety ring is used it is preferred that the ratio between the total wing area and the total inner ring area be between about 0.5 and 1.8.

Further, the ratio between the wing length (in cm) and the total volume of the device (in $cm^3$) is preferably greater than 1.

Clearly the various ratios will tend to vary with the number of wings used and also the degree of raking of the wings 11 which will be described below in relation to FIGS. 6 and 7.

It is envisaged tht the boomerang device of the present invention will be manufactured in one piece by being moulded from plastics material. However it can also be manufactured from other light materials such as plywood.

In particular, the boomerang devices of the present invention can be moulded in a single piece from flexible thermoplastics material particularly a resilient material such as polypropylene. This allows a user to bend the wings himself at will to any desired shape either up or down. If the wings are bent down the device tends to have a wide low circular flight which is good in windy conditions. If the wings are bent up, the device tends to have a high hovering flight which is good in still conditions. With a resilient material such as polypropylene the boomerang device tends to return to its substantially flat shape in time.

Figure 6:
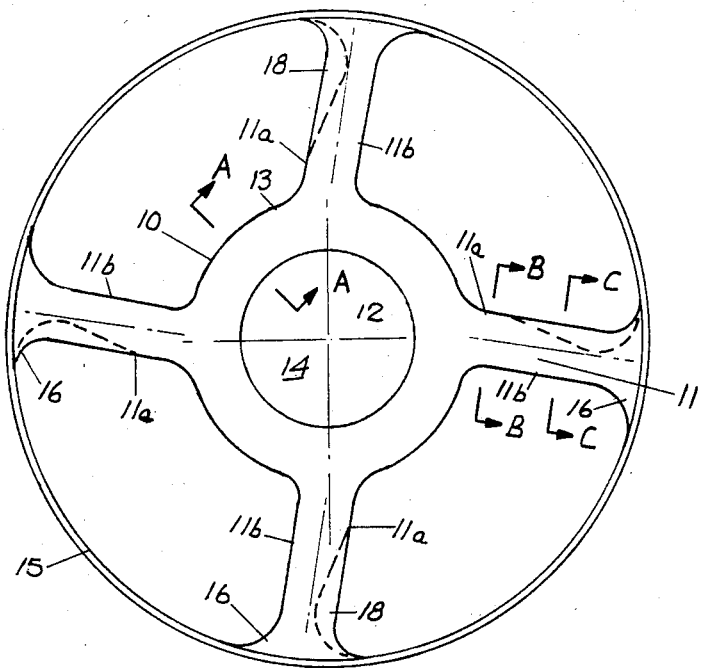
FIG. 6 shows a plan view of a boomerang device in accordance with the present invention which is to the same general design as the boomerangs of FIGS. 1 to 5 but has backswept wings.

In FIG. 6, there is shown a boomerang device of the same general type shown in FIGS. 1 and 2 having four equiangularly spaced wings 11. Like reference numberals denote like parts.

However, the wings 11 do not extend diametrically, as in FIGS. 1 and 2, outwardly from the ring 10, but are backswept. The wings 12 may be backswept by an angle in the range from 2° to 20° preferably 3° to 10°.

Figure 7:
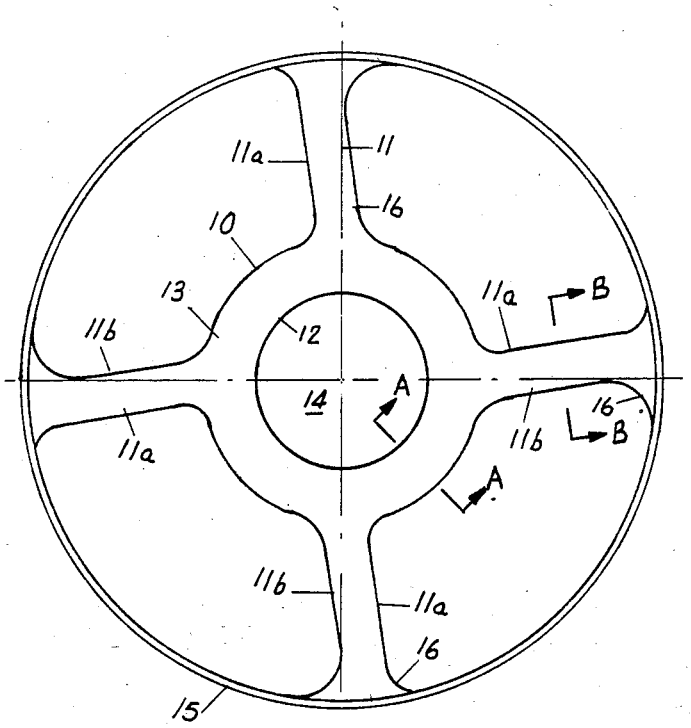
FIG. 7 shows a plan view of a boomerang device in accordance with the present invention which is to the same general design as the boomerangs of FIGS. 1 to 5 but has forwardly swept wings

In FIG. 7, there is shown a boomerang device also of the same general type disclosed in FIGS. 1 and 2 but having four equiangularly spaced wings 11 which are forwardly swept. The wings 11 may be forwardly swept by an angle in the range from 5° to 30° preferably from 10° to 25° such as 16°.

Figure 6A:
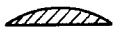
FIG. 6A is a section along the line A—A of FIG. 6.
Figure 6B:
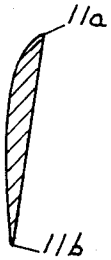
FIG. 6B is a section along the line B—B of FIG. 6.
Figure 7A:
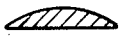
FIG. 7A is a section a along the line A—A of FIG. 7.
Figure 7B:
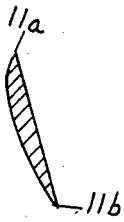
FIG. 7B is a section along the line B—B of FIG. 7.

As shown in FIGS. 6A and 7A, the rings 10 have a symmetrical aerofoil cross-section as with the embodiment of FIGS. 1 and 2. Also, as shown in FIGS. 6B and 7B, each wing 11 in each of these embodiments has an asymmetrical aerofoil cross section having a thicker portion adjacent a leading edge 11*a*, and a thinner portion adjacent a trailing edge 11*b*.

Also, it should be noted that in the embodiment of FIG. 7, the wings 11 are tapered in plan so that the sides of the wings 11 converge together slightly away from the ring 10.

Figure 6C:
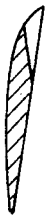
FIG. 6C is a section along the line C—C FIG. 6.

Further, as shown in FIGS. 6 and 6C, the outer leading edges, in use, of the wings 11 of the embodiment of FIG. 6 of the present invention may be provided with undercut portions 18 which improves the flight characteristics of the boomerang device of FIG. 6.

By sweeping the wings either forwardly or backwardly, drag is reduced and the device is able to remain spinning for longer than would otherwise be the case.

Sweeping the wings also enables a larger flight surface to be incorporated within a smaller diameter.

This favourably affects the lift to spin ratio and increases the relative size of the inner ring 10.

Further, the direction of the sweep affects the trajectory of the device. Forward swept wings (as in FIG. 7) produce a wide low circular flight while the backswept wings (as in FIG. 6) give a high, elliptical hovering flight.

The use of an inner ring 10 compared to a small hub more efficiently conserves the spin of the device since it acts like a flywheel. Further, the inner ring 10 produces lift in addition to the wings 11 since it also has an aerofoil section. The lift produced by the inner ring is more of a gliding lift than a turning lift.

The wings 11 have higher lift on the side of the advancing wing since it has a higher airspeed than the retreating wing on the other side. Thus, the boomerang tends to lift on its advancing side and to dip on its retreating side. This is what is termed the rolling moment.

The inner ring 10 also acts as a convenient and safe means of catching the device on the return.

Further, the boomerang device in all embodiments of the present invention is substantially planar and is devoid of projections deviating at a large angle from the general plane of the boomerang device such as an axial stick, stem, handle or the like as is found in some prior art devices.

Further, the outer drag skirts 16 of the boomerang of the present invention help to reduce spin drag and thus increase effective flight duration. It should be noted that in FIGS. 6 and 7, the drag skirt 16 adjacent the trailing edge 11*a* of each wing 11 is larger than the drag skirt adjacent the leading edge 11*b*. The skirts 16 also provide a convenient flange to accept the index finger of the thrower. This enables the thrower to more readily impart spin to the boomerang when throwing.

Modifications and variations such as would be apparent to a skilled addressee are deemed within the scope of the present invention. For example, the aerofoil sections shown in the drawings have flat reverse surfaces. These surfaces could if desired be made concave especially when the boomerang devices are moulded from plastics material.

I claim:

1. A substantially flat boomerang device comprising a flat central ring member having inner and outer substantially circular boundaries and defining a central aperture, at least two wing members projecting outwardly from the outer boundary of the central ring member substantially in the plane thereof, each wing member being of asymmetrical aerofoil section and being arranged to act in the same direction as all of the other wing members, such that when the device is thrown with a rotary motion the wing members produce lift and also turn, the central ring member being of symmetrical aerofoil section and the symmetrical aerofoil shape being on the side of the central ring member such as to augment lift produced by said wing members in flight, and said wing members being all of the same length and having outer ends interconnected by a circular outer ring member, at least the trailing sides of the junctions between each of the wing members and the outer ring member being provided with a flat, drag-geducing skirt extending between a side of the wing members and adjacent sides of the outer ring member.

2. A boomerang device according to claim 1, in which the leading and trailing sides of the junctions between each of the wing members and the outer ring member are provided with drag-reducing skirts extending between the sides of the wing members and adjacent sides of the other ring member.

3. A substantially flat boomerang device comprising a flat central ring member having inner and outer substantially circular boundaries and the defining a central aperture, at least two wing members projecting outwardly from the outer boundary of the central ring member substantially in the plane thereof, each wing member being of asymmetrical aerofoil section and being arranged to act in the same direction as all of the outer wing members, such that when the device is thrown with a rotary motion the wing members produce lift and also turn, the central ring member being of symmetrical aerofoil section and the symmetrical aerofoil shape being on the side of the central ring member such as to augment lift produced by said wing members in flight, and said wing members being all of the same length and having outer ends interconnected by a circular outer ring member, the wing members being backwardly swept by an angle in the range of 2° to 20° from a direction normal to the central ring member.

4. A substantially flat boomerang device comprising a flat central ring member having inner and outer substantially circular boundaries and the defining a central aperture, at least two wing members projecting outwardly from the outer boundary of the central ring member substantially in the plane thereof, each wing member being of asymmetrical aerofoil section and being arranged to act in the same direction as all of the other wing members, such that when the device is thrown with a rotary motion the wing members produce lift and also turn, the central ring member being of symmetrical aerofoil section and the symmetrical aerofoil shape being on the side of the central ring member such as to augment lift produced by said wing members in flight, and said wing members being all of the same length and having outer ends interconnected by a circular outer ring member, the wing members being backwardly swept by an angle in the range between 3° to 10° from a direction normal to the central ring member.

* * * * *

UNITED STATES PATENT AND TRADEMARK OFFICE

CERTIFICATE OF CORRECTION

PATENT NO. : 4,591,164

DATED : May 27, 1986

INVENTOR(S) : Marshall Rushton Blight

It is certified that error appears in the above-identified patent and that said Letters Patent is hereby corrected as shown below:

Column 1, line 51, after the word "section" delete the word "a".

Column 5, line 5, delete "11a" and insert --11b--;

line 6, delete "11b" and insert --11a--;

line 36, "drag-geducing" should be --drag-reducing--.

Signed and Sealed this

*Thirtieth* Day of *September 1986*

[SEAL]

*Attest:*

DONALD J. QUIGG

*Attesting Officer*

*Commissioner of Patents and Trademarks*